US005684442A

United States Patent [19]

Hufschmid

[11] Patent Number: 5,684,442

[45] Date of Patent: Nov. 4, 1997

[54] ELECTROMAGNET SWITCHING DEVICE, ESPECIALLY CONTACTOR

[75] Inventor: Max Hufschmid, Niedererlinsbach, Switzerland

[73] Assignee: Allen-Bradley Company, Inc., Milwaukee, Wis.

[21] Appl. No.: 592,144

[22] Filed: Jan. 26, 1996

[51] Int. Cl.[6] ..... H01H 67/02

[52] U.S. Cl. ..... 335/132; 335/202

[58] Field of Search ..... 335/132, 202

[56] References Cited

U.S. PATENT DOCUMENTS 4,371,855 2/1983 Lenzing ..... 335/132

5,281,937 1/1994 Young ..... 335/132

*Primary Examiner*—Lincoln Donovan

*Attorney, Agent, or Firm*—John M. Miller; John J. Horn

[57] ABSTRACT

The electromagnetic switching device, especially contactor consists of an electromagnet (2) fastened in its housing, with a core (2) and an armature (14). Mounted on the core (2) is a magnet coil (17) carrying the coil assembly (7) and coil terminal parts (8) protruding only in one direction. The coil assembly (7) can be installed into the housing in two 180° offset positions, around the winding axis of the magnet coil (17). The electromagnetic switching device can be used with unchanged inscription at 180° offset coil terminal parts (8).

2 Claims, 3 Drawing Sheets

ELECTROMAGNET SWITCHING DEVICE, ESPECIALLY CONTACTOR

The presented invention relates to an electromagnetic switching device, especially conductor, with an electromagnet fastened in a case, and with at least one magnet coil and its coil terminal parts that protrude only in one direction, carrying the coil assembly attached inside the case.

According to DE-A1-4406682, an electromagnetic switching device is known, with which a magnet coil carrying coil assembly is provided either with two coil clamps that protrude in only one direction, or with three coil clamps, whereby two point into one direction and one into the opposite direction, but is electrically connected with one of the other two. This magnet coil arrangement permits connection to the magnet coil either only from one side, or from both sides with one connection each from either side. The magnet coil carrying magnet coil assembly can be installed in the case in one specific position only. The disadvantage of this arrangement is that—when assembling the contactor with another device, especially with a power switch as for example already known from FR-A1-2695754—the coil clamps are positioned in an inaccessible location on the side facing the contactor, if the contactor was meant to be assembled with an over-current relays and/or a circuit breaker for protection against shorts. In this application, another device—for example a circuit breaker or a power switch—can be attached to the contactor, optionally on either side, whereby the inscription in one of the two cases will be positioned upside down, or must be offset by 180°.

The task of the presented invention is to develop an electromagnetic switching device of the type previously mentioned, on which the coil terminals of the electromagnetic switching device can be adjusted to the installation arrangement in a simple and economically advantageous manner, without having to accept an upside down inscription.

The posed task is solved by permitting installation of the coil assembly in two positions relative to the winding axis of the coil, 180° offset from each other. Thus, the coil terminals can be located on the accessible side of the electromagnetic switching device through this simple and economically advantageous measure, leaving the inscription of the switching device unchanged.

At their connecting locations advantageously, the housing as well as the coil assembly are equipped with interlocking positioning elements, effective for both 180° offset assemblies. The positioning elements secure the position of the coil assembly in the housing in both 180° offset uses of the coil assembly.

Figure 1:
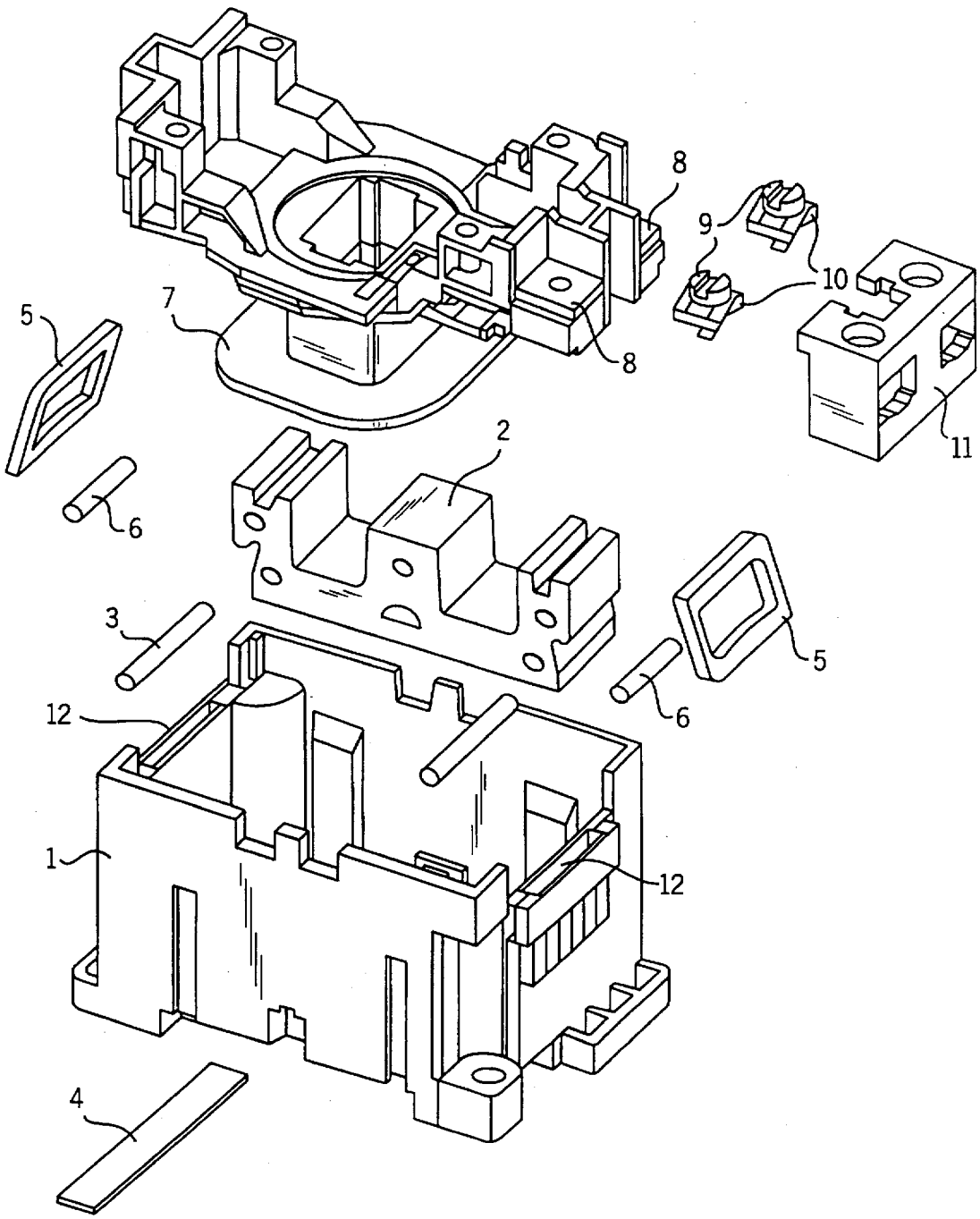
Figure 2:
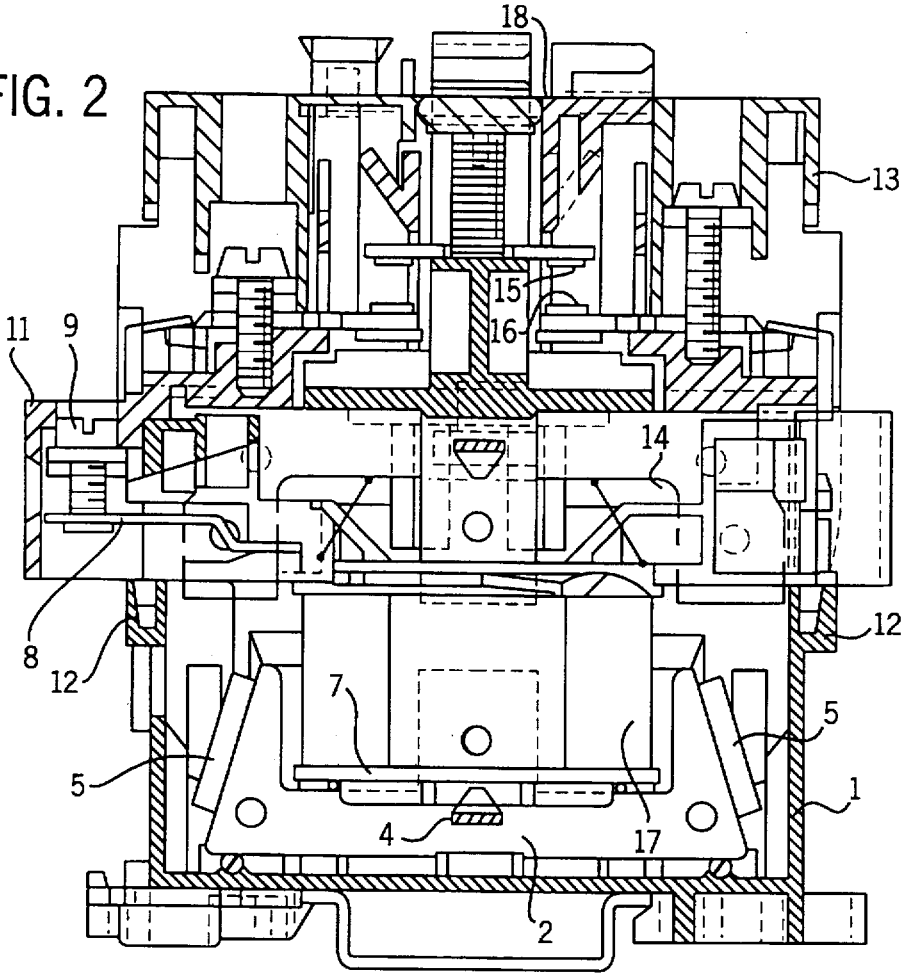
Figure 3:
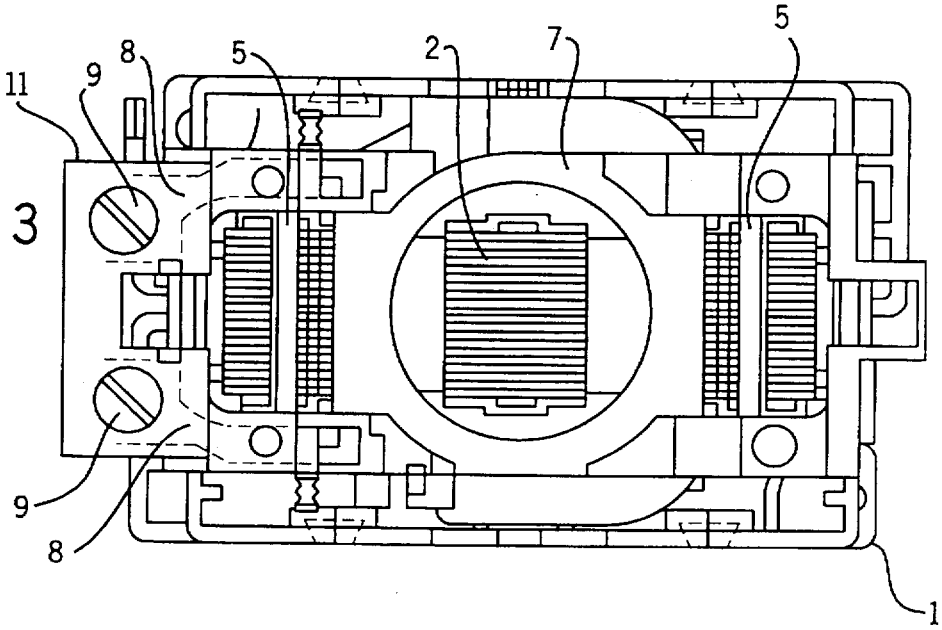
Figure 4:
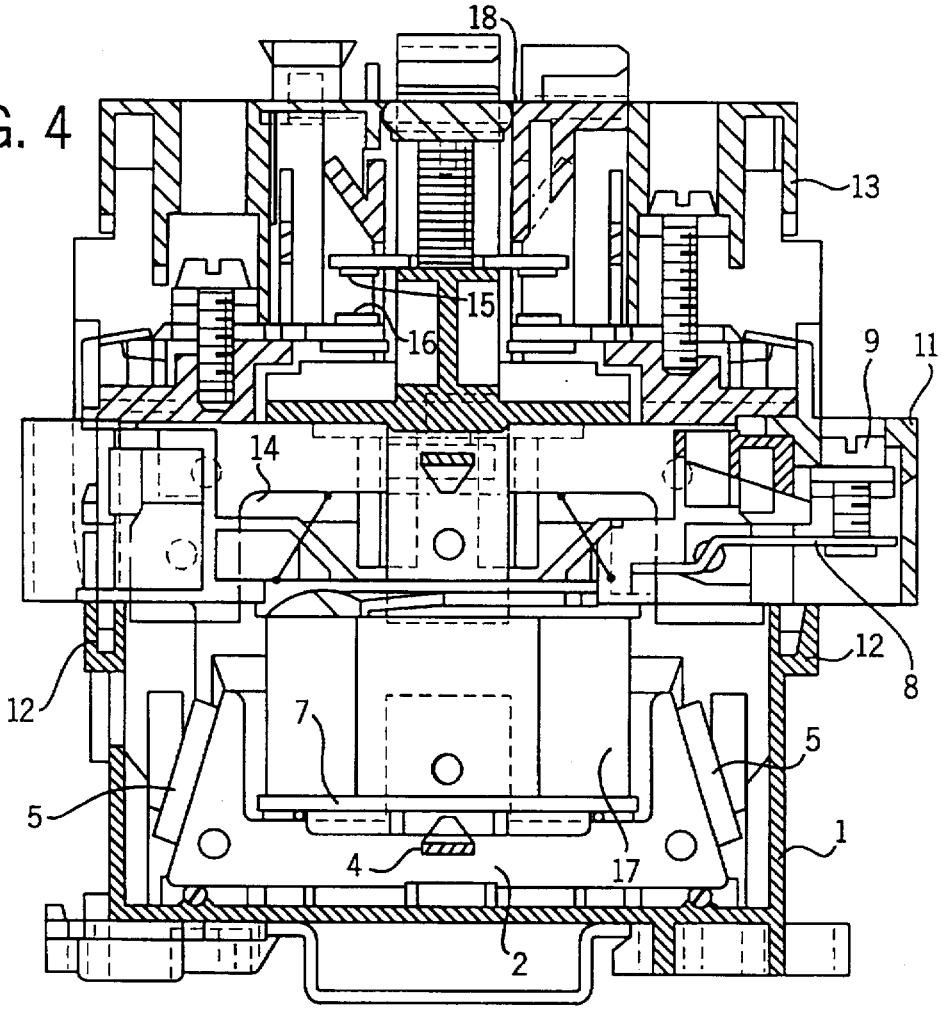
Figure 5:
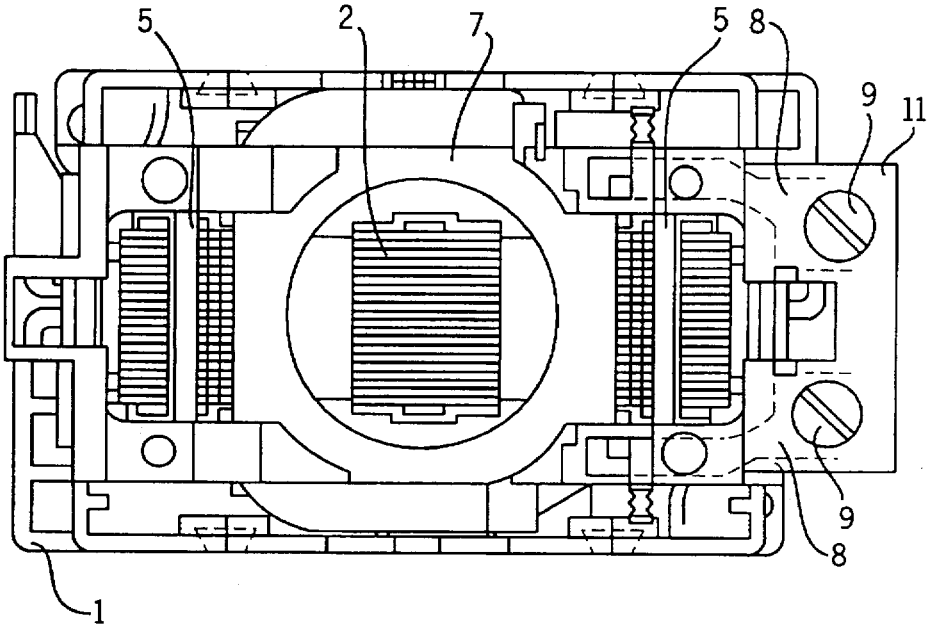

The invention will be further described in the following by means of the enclosed drawings for an implementation example. It is shown in:

FIG. 1 an exploded assembly drawing of the lower part of an electromagnetic switching device, FIG. 2 the cross section of an electromagnetic switching device with coil terminal parts located on the left side in the drawing, FIG. 3 the top view of the lower part of this switching device, FIG. 4 the cross section of an electromagnetic switching device with coil terminal parts located on the right side in the drawing and FIG. 5 the top view of the lower part of this switching device.

FIG. 1 shows the exploded view of the most essential components of an electromagnetic switching device which are located in the lower part of the housing 1. The core 2 of the electromagnet can be mounted in the lower housing 1 by means of a metal strip 4 and assembly of two spring loaded damping rods 3. Shorting rings 5 are snapped in with elastic damping rods 6 on both side arms of the core 2. A coil assembly 7 is shown without windings in FIG. 1. Two protruding coil terminal parts 8 are provided only in one direction for both winding ends of coil assembly 7. The connecting wires (not shown) can be attached to the coil terminal parts by means of clamping screws 9 and clamps 10. Cover 11 serves as concealment of voltage carrying parts. The coil assembly 7 can be mounted in the housing in two positions on the center arm of core 2, 180° offset relative to the winding axis of the magnet coil. The lower part of the housing 1 as well as the coil assembly 7 are provided with effective, interlocking positioning elements 12 at the engaging locations in both 180° offset positions.

FIG. 2 shows the cross section of a complete electromagnetic switching device with coil terminal parts 8 drawn on the left. The coil assembly 7 is firmly secured in the housing by means of its upper part 13. The armature 14 with the movable contact parts 15 and the stationary contact parts 16 are contained in the upper part 13 of the housing, just to mention the most essential components. The upper part 13 is fastened to the lower part 1 by means that are not illustrated further.

FIG. 3 illustrates the electromagnetic switching device in top view with the upper portion 13 removed, and that was shown as cross section in FIG. 2. In this position, the coil assembly 7 can be pulled out from the lower portion 1 of the housing. In FIG. 3 it is clearly noticeable that the coil terminal parts 8 are located on the left side of the housing.

FIG. 4 illustrates the same switching device in cross section as in FIG. 2. The only difference between both FIGS. 2 and 4 is that the coil terminal parts 8 of the electromagnetic switching device in FIG. 4 are located on the right and not on the left side of the switching device, and that, compared with the coil assembly 7 shown in FIG. 2, the entire coil assembly 7 is offset or rotated by 180° around the winding axis of the magnet coil 17.

FIG. 5 illustrates the electromagnetic switching device without upper portion 13, previously shown ,as cross section in FIG. 4. By comparing FIGS. 3 and 5 it is clearly noticeable that the coil assembly 7 was relocated from the position shown in FIG. 3 into the position shown in FIG. 5, by rotating the magnet coil around the winding axis of the magnet coil 17. The position of the lower portion 1 and the upper portion 13 of the housing remains unchanged when rotating the coil assembly 7 by 180° around the winding axis of the magnet coil 17. Inscriptions attached to the surface 18 of the housing remain unchanged despite the 180° changed position of the coil terminal parts 8.

The described electromagnetic switching device lends itself to be assembled with, for example, a circuit breaker on one side of the switching device or optionally with a power switch on the other side of the switching device, but with the inscription of the switching device remaining unchanged on the free side of the switching device with easily accessible coil terminal parts 8.

I claim:

1. An electromagnetic switching device comprising:

a housing;

a core fastened within the housing, the core defining a winding axis;

a generally symmetrical coil assembly disposed about the winding axis, the coil assembly shaped so as to fit within the housing in two positions offset by 180° with respect to the winding axis; and at least two terminal parts coupled to the coil assembly, the terminal parts protruding in one direction from the housing.

2. The electromagnetic switching device as set forth in claim 1 further comprising: interlocking positioning elements disposed on the housing and the coil assembly.

* * * * *